US006168298B1

(12) United States Patent
Hentz et al.

(10) Patent No.: US 6,168,298 B1
(45) Date of Patent: Jan. 2, 2001

(54) TRIM RETENTION GRAVITY INVERSION CLIP

(75) Inventors: Joseph A. Hentz, Crawfordsville; Richard F. Ashcraft, Greenwood; James M. Mershon, Crawfordsville, all of IN (US)

(73) Assignee: NSI Enterprise, Inc., Atlanta, GA (US)

( * ) Notice: Under 35 U.S.C. 154(b), the term of this patent shall be extended for 0 days.

(21) Appl. No.: 09/201,315

(22) Filed: Nov. 27, 1998

(51) Int. Cl.[7] ..... F21S 8/02
(52) U.S. Cl. ..... 362/365; 362/148; 362/288
(58) Field of Search ..... 362/365, 366, 362/148, 288

(56) References Cited

U.S. PATENT DOCUMENTS

| | | | | |
|---|---|---|---|---|
| 3,099,404 | * | 7/1963 | Kaufman et al. | 362/366 |
| 4,760,510 | * | 7/1988 | Lahti | 362/365 |
| 5,609,414 | * | 3/1997 | Caluori | 362/365 |
| 5,707,143 | * | 1/1998 | Hentz | 362/365 |
| 5,758,959 | * | 6/1998 | Sieczkowski | 362/365 |
| 5,941,625 | * | 8/1999 | Morand | 362/148 |

FOREIGN PATENT DOCUMENTS

| | | | | |
|---|---|---|---|---|
| 1304849 | * | 8/1962 | (FR) | 362/365 |
| 1558546 | * | 1/1964 | (FR) | 362/365 |

* cited by examiner

*Primary Examiner*—Alan Cariaso
*Assistant Examiner*—Peggy A. Neils
(74) *Attorney, Agent, or Firm*—Kenneth E. Darnell

(57) ABSTRACT

A clip formed of flat spring steel stock material and operable in association with a lamp housing mounting arrangement of a downlighting fixture to exert a force on a lighting trim through the lamp housing to retain the trim snugly against a ceiling about an opening in the ceiling through which at least lowermost portions of the lamp housing and/or trim extends, an environmental space beneath the opening being illuminated through the opening by lamping carried by the lamp housing. In the preferred embodiment, an adjustable, U-shaped mounting yoke is carried by a conventional downlighting pan with the bight of the yoke being disposed immediately over a socket cup mounted to an uppermost end of the lamp housing or reflector, the clip extending between spaced arms of the yoke and being attached to a central portion of the clip. Upward displacement of the lamp housing after attachment to the clip causes the clip to deform and bias the lamp housing and associated trim upwardly to hold annular flanged lowermost portions of the lamp housing or trim in place about the ceiling opening to prevent light leakage and to provide a pleasing appearance. Alternate embodiments include spring elements formed of bent wires as well as strap stock which are configured to exert a force on a lamp housing or trim to maintain the lamp housing or trim about a ceiling opening.

22 Claims, 5 Drawing Sheets

Fig. 2
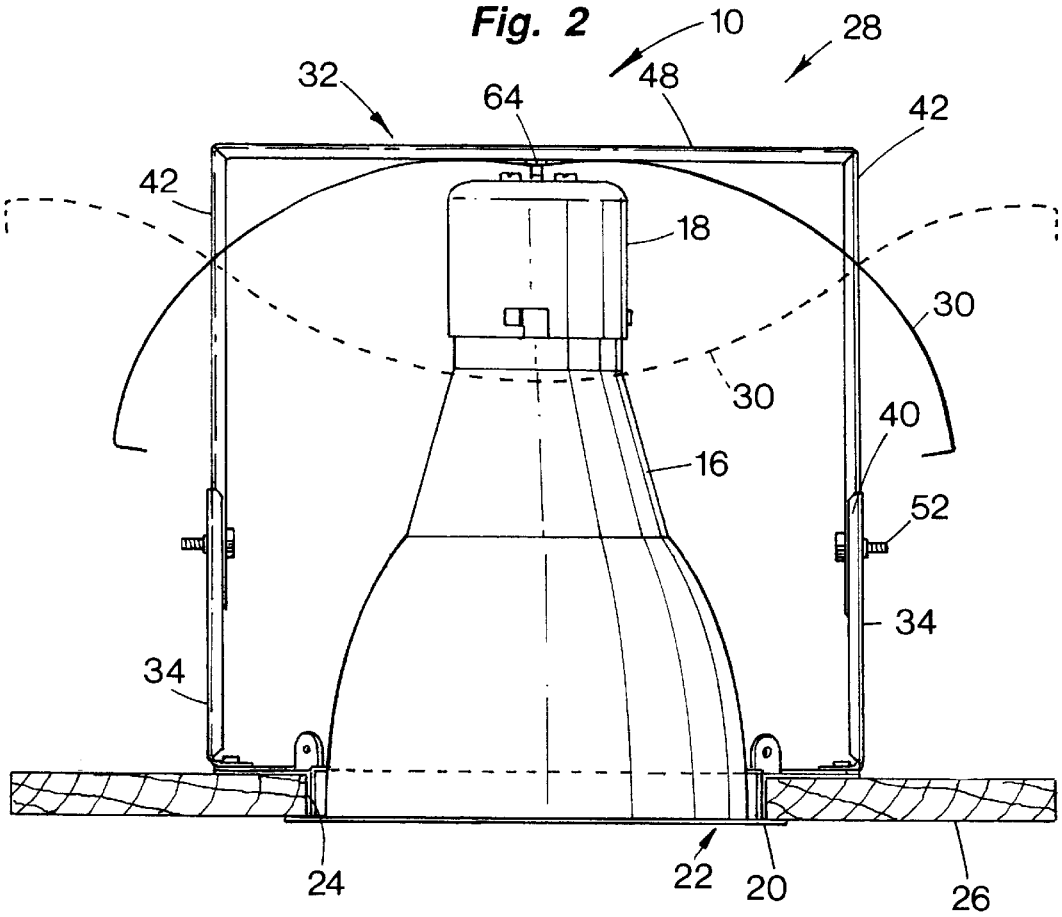
Fig. 3
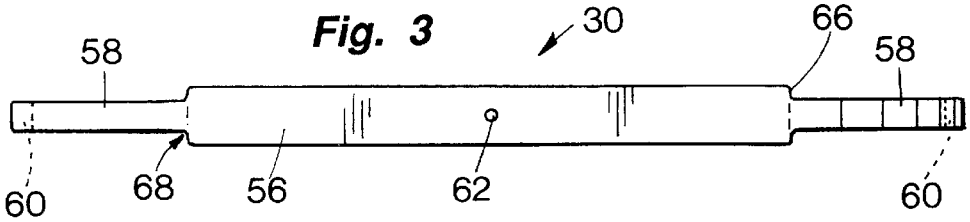
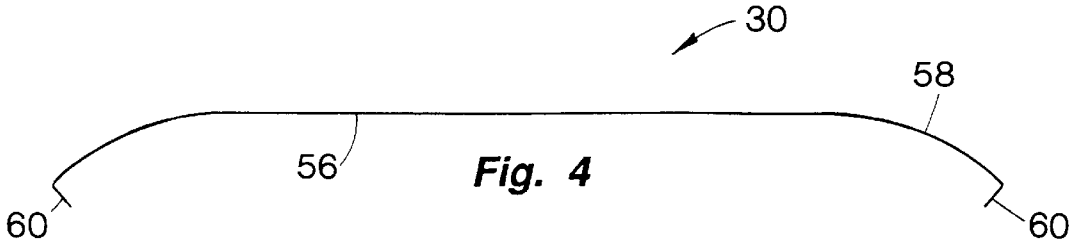
Fig. 4

TRIM RETENTION GRAVITY INVERSION CLIP

BACKGROUND OF THE INVENTION

1. Field of the Invention

The invention relates generally to ceiling-recessed downlighting fixtures and particularly to trim retention clip and mounting arrangements intended to facilitate snug mounting of a trim about a ceiling opening.

2. Description of the Prior Art

Lighting fixtures and particularly recessed downlighting fixtures mountable above the ceiling to building structural elements or to a gridwork of a suspended ceiling are commonly employed in both residential and commercial lighting applications due in part to the applicability of such lighting to an extraordinary variety of lighting applications as well as to the efficiency of such lighting. A description of recessed lighting fixtures in particular and components of such fixtures can be found in U.S. Pat. No. 5,690,423, the disclosure of which is incorporated hereinto by reference. While U.S. Pat. No. 5,690,423 provides particular disclosure of a pan or support element used for supporting the components of a downlighting fixture in place above a ceiling, it is to be understood that supporting pan structures of varying design are available in the art and that the present invention can be utilized with such supporting pan structures to produce the advantages described herein. In particular, downlighting pans conventionally mount a lamp housing and a junction box above an opening in a ceiling through which light is to be directed into an environmental space beneath the ceiling for illumination thereof. Electrical wiring is usually passed through a conduit between the junction box and the lamp housing for connection to lamping which produces the light directed into the environmental space. It is to be understood that the lamp housing can comprise a reflector per se such as is described in U.S. Pat. No. 5,800,050, the patent being assigned to the present assignee and being incorporated hereinto by reference. In this patent, the reflector itself also functions as a trim and as a lamp housing, a socket cup being mounted over an upper end of the reflector. Wiring from the junction box through the conduit connects to the socket cup to power lamping mounted within the reflector/lamp housing. An integral flange formed about an end of the lamp housing is intended to cover the ceiling opening and perimetric portions of the ceiling disposed about the opening. Similarly, a conventional can can be provided as the lamp housing either with or without reflector trim or finishing trim mounted within the interior of the can. In such situations, finishing trim is typically provided which has flange portions about a lowermost opening of the trim, the opening in the trim and an opening in the can being substantially coincidental. A flange formed about the trim opening covers the ceiling hole to prevent light leakage and to provide a pleasing appearance.

The prior art is replete with mounting arrangements including spring-like clips and the like which are intended to ensure that flanged lower portions of a lamp housing, reflector trim, finishing trim or the like are pulled into and held in snug engagement with the ceiling hole. However, component weight coupled with the eventual progress of time often causes such springs to function less than perfectly especially over time, the prior art thus feeling a long-standing need for a mounting arrangement which will positively hold a flanged lower end of a lamp housing, trim or the like in place against the force of gravity so that product performance is maintained over time. As an example, Caluori, in U.S. Pat. No. 5,609,414, describes a recessed lighting fixture having retaining clips which can be adjusted to secure a lamp housing in place about a ceiling opening. In U.S. Pat. No. 5,567,041, Slocum provides spring clips disposed about a lamp mounting can in a recessed lighting fixture, the spring clips being intended to support an exterior cylinder of a pair of cylinders within a ceiling hole, the interior cylinder then being positioned within the exterior ceiling, the cylinder mounting arrangement being intended to mount the fixture in place about the ceiling opening. Still further, Jones, in U.S. Pat. No. 5,314,148, describes a lamp-mounting can having a flange formed about a lowermost opening, the can being received into a ceiling opening such that the flange is flush with the surfaces of the ceiling about the opening. Jones then provides a pair of spring elements which are compressed and inserted through a pair of slots formed in walls of the housing, the springs bearing against the slot and the interior surface of the ceiling in order to hold the flanged can in a flush position with the ceiling opening. In U.S. Pat. No. 4,760,610, Lahti provides a mounting arrangement for a recessed electrical fixture wherein first and second spring supports and a locator plate are used to secure the spring supports to the fixture. Portions of the first and second spring supports bias against upper surfaces of a ceiling to maintain the fixture in position in an opening formed in the ceiling. While the prior art provides structure intended to produce a result essentially identical to the result provided by the present invention, it is to be noted that the prior art has experienced a long-felt need for a simple and inexpensive structure capable of mounting a recessed downlighting fixture above a ceiling hole to provide the functions herein described with a minimum of expense and with long-term reliability. The present invention in the several embodiments herein described provides structure for mounting a recessed lighting fixture in place above an opening in a ceiling to cause structure such as a flanged lamp housing or the like to be received into the opening such that a flange is pulled into engagement with ceiling portions about the opening to cover the opening.

SUMMARY OF THE INVENTION

The invention provides in embodiments explicitly described herein and implicitly disclosed mounting arrangements carried by a conventional supporting pan of a downlighting fixture to mount a lamp housing structure to the pan and to exert a force by means of a resilient clip and particularly a clip formed of flat spring steel stock on the lamp housing structure to cause the structure to be pulled inwardly or upwardly of a ceiling such that an annular flange forming the perimeter of an opening of the lamp housing structure as an example is pulled into engagement with perimetric portions of a ceiling surface adjacent the opening. Lighting trim which can take a variety of physical forms is thus caused to be pulled against the opening in a ceiling through which light is directed from a downlighting fixture, the resilient clip which forms the active portion of the lamp housing mounting arrangement acting to "invert" gravity in its action upon the lamp housing. The clip acts against the pull of gravity on the lamp housing to maintain the lamp housing in a desired position relative to the ceiling opening so that light leakage from perimetric portions of the opening about exterior surfaces of the lamp housing is prevented. The clip and mounting arrangements of the invention positively maintain a lamp housing or trim in place relative to the ceiling opening in order to provide a pleasing appearance.

The clip and mounting arrangement of the invention can be used with a variety of structure which will be described herein as "trim", the term trim including a self-supported reflector such as is commonly provided with a socket cup or the like for mounting lamping, the lamping being disposed within the interior of the reflector. In such situations, the reflector is usually provided with a finishing flange located outwardly of the opening in the distal end of the reflector, the opening in the reflector essentially being disposed coplanar with or in proximity to the ceiling opening with the flange providing a finished appearance as is well known in the art. A self-supporting reflector as described can also be provided with a finishing trim which would be inserted into the opening or "mouth" of the reflector, the finishing trim having a flange operable according to well-known principles in the downlighting arts to cover a ceiling opening. Still further, lamping can be housed through use of a "can" with the can carrying a lamp socket and lamping within the interior thereof, such a can typically having a reflector trim or finishing trim inserted into the mouth of the can to provide reflecting surfaces for improvement of lighting performance and also to provide a finishing flange operable as are the flanges described above. As can readily be seen, a lamp housing can take a variety of forms within a downlighting fixture and the present clip and lamp housing arrangements can be configured to accommodate this variety of structure. It is further to be noted that downlighting fixtures of differing description can be configured to function with the clip and mounting arrangements of the invention. In particular, mounting pans other than conventional flat pans can be employed, such pans being described as aforesaid in U.S. Pat. No. 5,690,423 or in U.S. Pat. No. 5,662,414, entitled "Thermoplastic Pan Assembly for Mounting Recessed Lighting Fixtures in Ceilings and the Like" the disclosure of which is incorporated hereinto by reference.

The mounting arrangements of the invention can take a variety of forms as can the clip employed to produce the "gravity inversion" function. In particular, the clip is preferably formed of flat spring steel stock material, and is formed in an unstressed state as an arcuate body member having reduced-in-width arms located one each on either end of the body member with angled tabs extending one each from each of the arms. A medial portion of the clip body member is attached to structure such as a lamp housing which either has a finishing flange formed integrally therewith or which carries a finishing trim having a finishing flange. The tabs on either end of the clip are then inserted into openings in a mounting structure such as can take the form of a yoke of substantially U-shaped cross section. The lamp housing attached to the medial portion of the clip is then moved into a mounting position within a ceiling opening with the clip therefore being inverted and deformed in shape, shoulders of the clip body member at those locations thereof from which the arms extend allowing only a certain freedom of movement of the clip relative to the mounting arrangement, the inverted clip exerting pressure against the yoke at the locations where the arms move relative to the yoke to exert a positive force upwardly on the lamp housing or "trim" in order to maintain the trim in proper relation to the ceiling and ceiling opening. In order to adjust the mounting arrangement, the yoke is carried for sliding movement by leg elements having scales which allow predetermined selection of the height of the mounting arrangement, the legs being mounted directly to the pan itself. Other clip structures include structure best formed of wire bent to a desired configuration.

Accordingly, it is an object of the invention to provide clip and mounting arrangements for downlighting trim which act to exert a force directly or indirectly on such trim to maintain a finishing flange of the trim in a covering relationship with a ceiling opening above which a downlighting fixture is mounted for illumination of an environmental space.

It is another object of the invention to provide a trim retention clip operable to "invert" gravity for exertion of a force on a trim having a finishing flange to maintain the trim in a desired relationship with a ceiling opening and to continuously exert a force on the trim against gravity for maintaining the trim and thus the finishing flange in a desired location.

It is a further object of the invention to provide mounting arrangements for a lamp housing and/or trim having a finishing flange and including a clip formed of flat spring steel carried for movement relative to the mounting arrangements by said arrangements and connecting directly or indirectly to a trim which can comprise a lamp housing having a finishing flange or a trim having a finishing flange and mounted to a lamp housing to which the clip is attached, the trim so mounted being drawn positively into a ceiling opening so that a finishing flange of the trim snugly engages about the ceiling opening to prevent light leakage and to provide a pleasing appearance.

Further objects and advantages of the invention will become more readily apparent in light of the following detailed description of the preferred embodiments.

BRIEF DESCRIPTION OF THE DRAWINGS

FIG. 2 is a side elevational view in partial section of a fixture configured according to the invention and shown in an assembled configuration, the clip of the invention being shown in phantom in the unassembled configuration;

FIG. 3 is a front elevational view of the clip of the invention;

FIG. 4 is a side elevational view of the clip of the invention;

DESCRIPTION OF THE PREFERRED EMBODIMENTS

Figure 1:
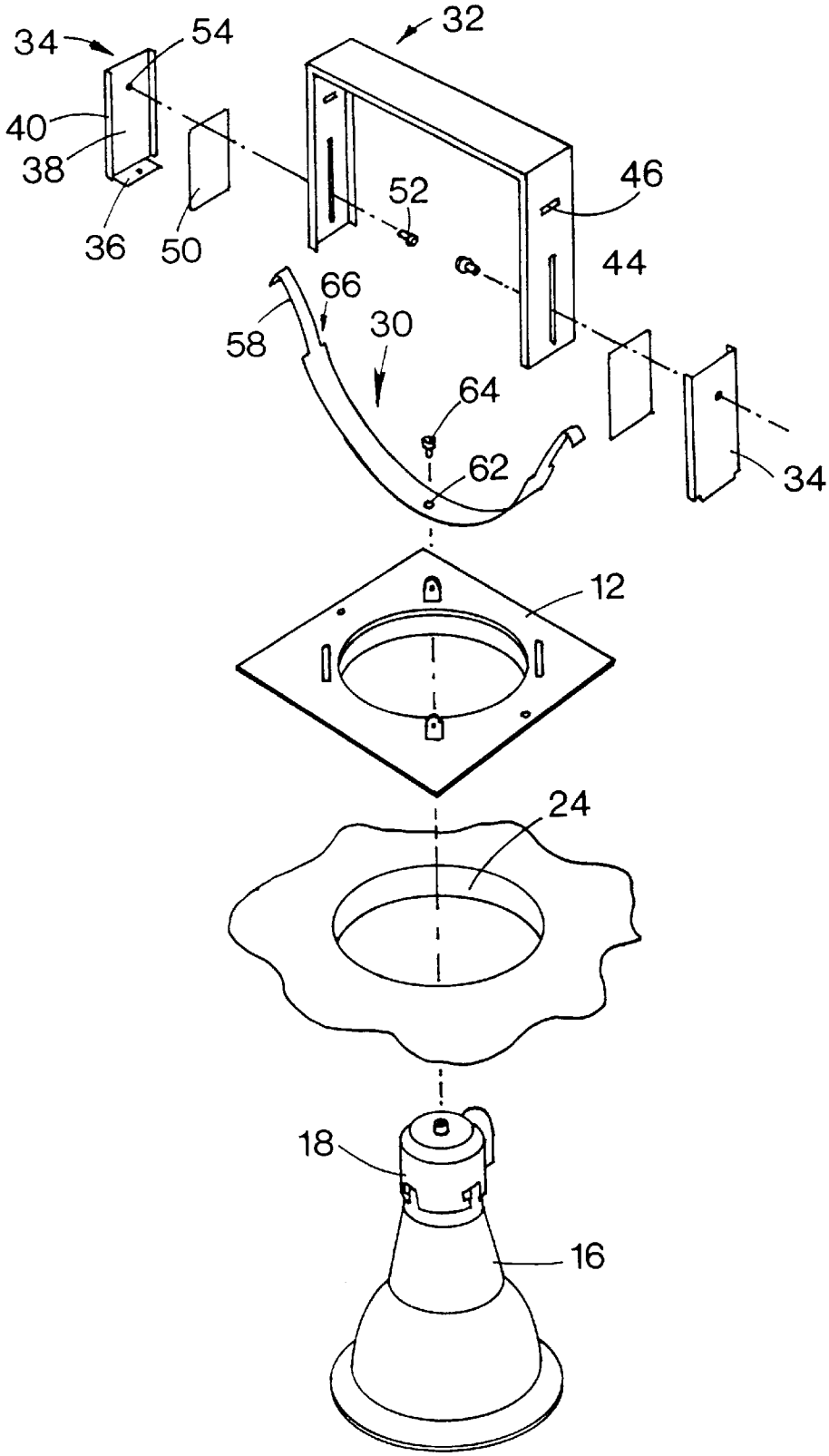
FIG. 1 is an exploded view in perspective of a particular embodiment of the invention wherein the clip of the invention is used with particular mounting structure such as would be employed in the use of a self-supporting reflector having an integral finishing flange, the reflector mounting a socket cup and having lamping connected to the socket cup and being disposed essentially within the confines of the reflector.

Referring now to the drawings and particularly to FIGS. 1 and 2, a downlighting fixture is seen generally at 10 to comprise a pan 12 and a lamp housing 16 of conventional design. The lamp housing 16 in this embodiment of the invention takes the form of a self-supporting reflector having a socket cup 18 mounted to an upper end thereof and terminating in a finishing flange 20 which forms an annulus about mouth 22 of the lamp housing 16. Although not shown, the fixture 10 would include a junction box inter alia to provide necessary function to the fixture.

FIG. 2 illustrates the placement of the pan 12 immediately above an opening 24 formed in ceiling 26 of an environmental space. Attachment structure such as is well known in the art is utilized to mount the assembly in place relative to the opening 24 such that the mouth 22 of the lamp housing 16 communicates with the interior of the environmental space surmounted by the ceiling 26. Light from lamping (not shown) mounted within the interior of the lamp housing 16 and provided with electrical power through the socket cup 18 from wiring (not shown) extending from a junction box (now shown) is directed through the mouth 22 of the housing 16 and thus into the interior of the environmental space surmounted by the ceiling 26.

In order to prevent light leakage from the ceiling opening 24 and also to provide a pleasing appearance, it is desirable that the finishing flange 20 fit snuggly about the opening 24 in the ceiling 26, it being necessary to accomplish this snug fit against the pull of gravity on the lamp housing 16.

In order to mount the lamp housing 16 appropriately and to exert a continuing force on the housing 16 to cause a snug fit between the flange 20 and the opening 24 of the ceiling, a mounting arrangement shown generally at 28 is provided which includes a clip 30, a yoke 32 and supporting legs 34. Each of the supporting legs 34 is substantially L-shaped in conformation with a base plate 36 being disposed perpendicularly to a body plate 38, lateral edges of the body plate 38 being turned inwardly to form a guideway 40 into which one of the legs 42 can be slidably received so that the yoke 32 can be moved vertically relative to the supporting legs 34 and thus the pan 12. The supporting legs 34 are each mounted to the pan 12 by means of screws or the like. Each leg 42 of the yoke 32 is provided with a slot 44 which extends vertically and longitudinally along the leg 42. A slot 46 is formed in each of the legs 42 above the slot 44 and near upper ends of the legs 42. The yoke 32 is completed by the provision of a bight 48 which joins the legs 42.

Scale plates 50 can be fitted on inner vertical wall surfaces of the supporting legs 34 so that the yoke 32 can be mounted at a desired location relative to the supporting legs 34, screws 52 or similar fasteners being used to mount the yoke 32 through the respective slots 44 aligned with threaded apertures 54 formed near upper ends of the supporting legs 34.

The yoke 32 can therefore be positioned above the plane of the pan 12 at a desired height. More importantly, the slots 46 formed in the respective legs 42 are positioned a desired height above the plane of the pan 12. In a preferred embodiment, the slots 46 are essentially rectangular in shape and are disposed horizontally relative to the plane of the pan 12.

Referring now to FIG. 1 and also to FIGS. 3 and 4, the clip 30 is seen to comprise a strap-like structural element which can be formed of flat spring steel stock material or similar material having resilience such that the clip 30 when properly mounted by the mounting arrangement 28 will exert a continuous force on the lamp housing 16 to cause proper seating of the finishing flange 20 about the opening 24. The clip 30 comprises a main body portion 56 of a thickness of approximately 0.020 inch with a Rockwell hardness of C45 to C48. A preferred material is 302 full hard stainless steel. It is to be noted that the clip 30 can be deformed at least within certain limits and returned to the conformation shown in FIGS. 3 and 4 when at rest. The ends of the main body portion 56 terminate in angled straps 58 which bend from the plane of the main body portion 56 when the clip 30 is at rest. The respective ends of the straps 58 terminate with tabs 60 which bend from the straps 58 respectively at angles of approximately 90° from a line tangent to each strap 58 at the juncture thereof with the tabs 60. The tabs 60 are typically about one-half inch in length with the clip 30 at rest being approximately 16 inches in length, each strap being approximately 3 inches in length. The width of the main body portion 56 is taken in preferred embodiments to be approximately one inch with the width of the straps 58 being approximately one-half inch. The radius of the straps 58 relative to a plane within which the main body portion 56 lies is approximately 4.2 inches. Corners of the main body portion 56 proximus to the juncture of the angled straps 58 thereto have radii of approximately 0.1 inch. An aperture 62 is formed medially of the main body portion 56 and receives a screw or similar fastener 64 therethrough to connect to the socket cup 18 as is best seen in FIG. 1. The screw 64 can attach the clip 30 to the socket cup 18, and thus the lamp housing 16, either before or after the ends of the clip 30 are received into the slots 46 formed in the respective legs 42 of the yoke 32. In a well-organized installation of the fixture 10, the mounting arrangement 28 is first mounted to the pan 12 with the supporting legs 32 being attached to the pan 12 followed by mounting of the yoke 32 to the legs 34 at a desired location measured by the scale plates 50, the screws 52 being used to positively connect the yoke 32 to the legs 34. The screw 64 is then used to connect the clip 30 to the socket cup 18 and thus to the lamp housing 16, this assembly being extended from beneath the ceiling 26 into the opening 24 with the tabs 60 of the clip 30 then being inserted one each into the slots 46 of the yoke 32, the clip 30 staying in place until further assembly due to the fact that the tabs 60 are angled relative to the straps 58. In this conformation, the clip 30 generally assumes the shape shown in FIG. 1 and also in phantom in FIG. 2. The lamp housing 16 is then further inserted into the opening 24 to an engagement of the flange 20 with perimetric portions of the ceiling 26 about the opening 24 to seat the finishing flange 20 in a desired relation with the ceiling opening 24. This insertion causes deformation of the clip 30, thereby to cause each of the straps 58 to push through the respective slots 46 until further movement of the straps 58 within the slots are prevented by engagement of shoulder portions 66 of the main body portion 56 against interior wall portions of the yoke legs 42 on either side of the slots 46. In other words, the width of the straps 58 are dimensioned along with the dimensions of the slots 46 to allow movement of the straps 58 through the slots 46. However, the main body portion 56 of the clip 30 cannot move through the slots 46 due to the greater width of the main body portion 56. The resilient clip 30 therefore biases against each of the legs 42 to exert an upwardly displacing force against the lamp housing 16. The finishing flange 12 is thus continuously urged into a snug fit within the opening 24 and the ceiling 26.

Although the clip 30 has been described hereinabove as being formed from resilient strap stock, it is to be understood that a similar clip (not shown) could be formed of wire stock with a wire similar to piano wire being formed in the shape of the perimeter of the clip 30 with a platform (not shown) being medially disposed of such a wire clip for attachment to a socket cup, reflector or lamp housing of other description. The ends of such a wire frame clip would function in essentially the same manner as corresponding structure of the clip 30. Embodiments of the present clip structure which are described hereinafter have similarities to a wire frame clip configured essentially as described relative to modification of the clip 30. It is further to be noted that the clip 30 and modifications thereof can be attached directly to a reflector or finishing trim even though FIGS. 1 and 2 show such an attachment to a socket cup such as the socket cup 18. Essentially, the clip 30 or modifications thereof require connection either directly or indirectly to structure on which a finishing flange such as the flange 20 is provided so that force can be exerted through such a connection to cause the flange 20 to be pulled tightly against a ceiling opening or the like as has been described herein.

Figure 5:
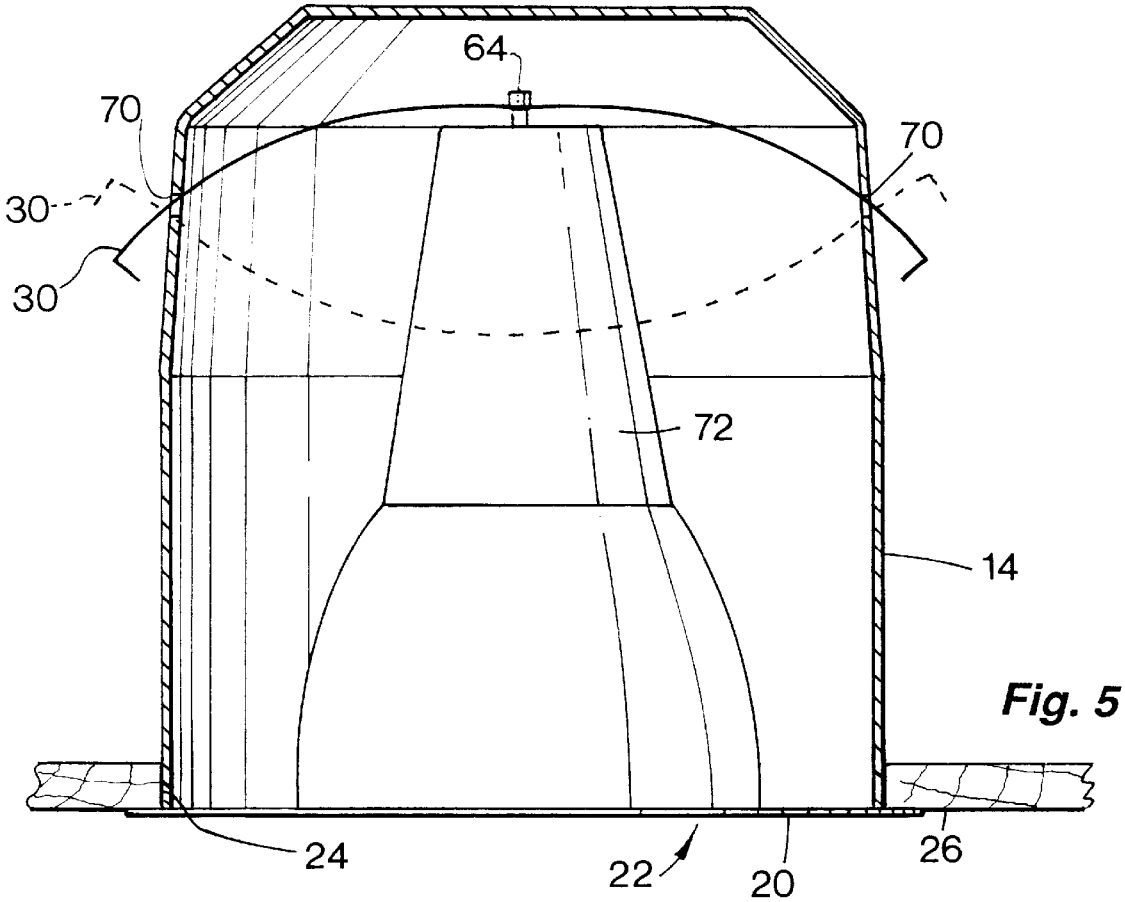
FIG. 5 is a side elevational view in partial section of an embodiment of the invention configured with the mounting arrangement of the invention disposed interiorly of a lamp housing which takes the form of a can.

Further note should be taken and reference made to FIG. 5 wherein the clip 30 mounts at its ends through slot openings 70 formed in oppositely disposed side walls of a can 14, the can 14 effectively acting as a frame functionally identical to the yoke 32 of FIGS. 1 and 2. In FIG. 5, the clip 30 attaches directly to a reflector 72. It is to be understood that a socket or a socket cup such as the socket cup 18 of FIGS. 1 and 2 could be employed in the structure of FIG. 5 to provide intermediate connection between the clip 30 and the reflector 72.

Figure 6:
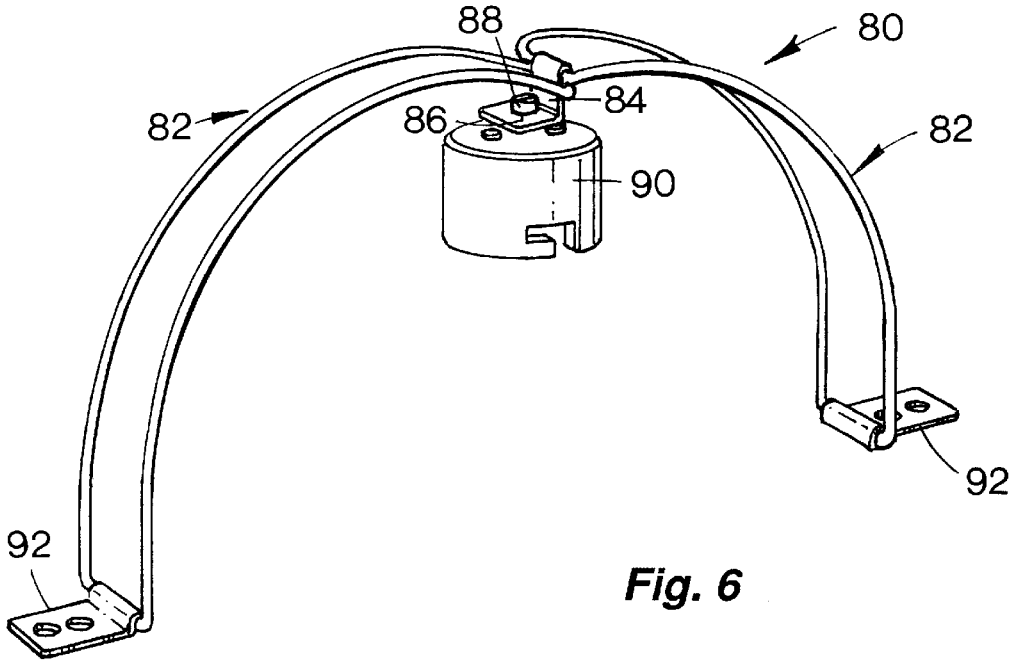
FIG. 6 is an idealized perspective view of another embodiment of a clip structure which is formed of resilient wire and which includes pivotable central structure which can be connected to a socket cup or reflector of a lamp housing.

FIG. 6 is seen to provide an idealized view of a clip 80 formed of a wire such as music wire, the clip 80 being formed of two substantially arcuate body elements 82 pivotally connected at inner ends by means of a pivot platform 84 having an aperture 86 formed therein to receive a screw 88 for connection to a socket cup 90 or to a reflector or lamp housing trim or the like. The body elements 82 are pivotally connected at outer ends to respective platforms 92 which are connected directly to a pan structure which is not shown in the figure. The clip 80 through the resilient body elements 82 thus exerts an upward force on the socket cup 90 and the reflector/lamp housing/trim mounted by the socket cup 90.

Figure 7:
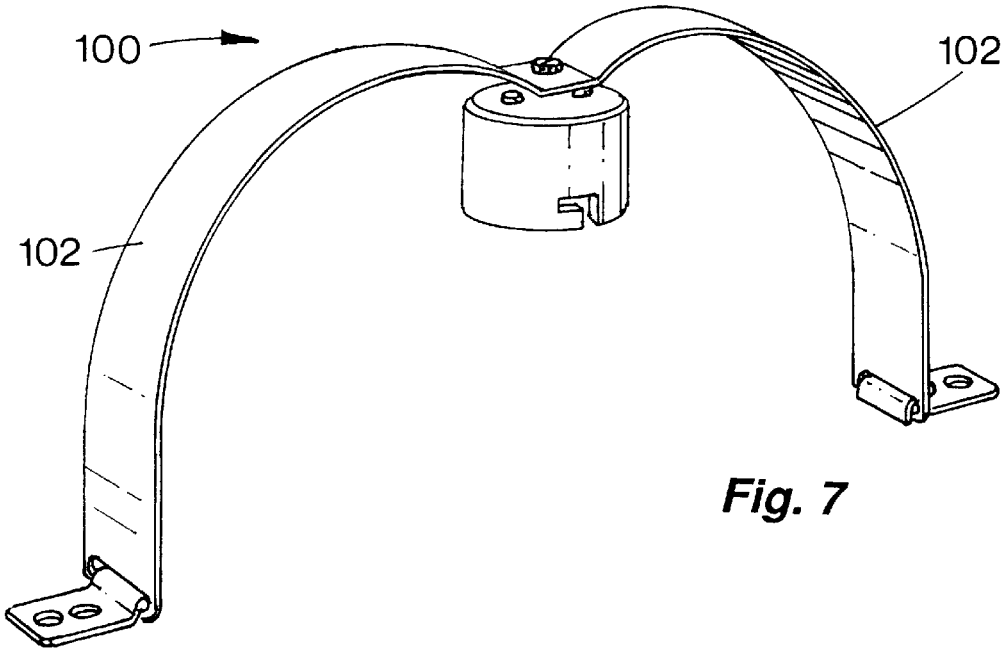
FIG. 7 is an idealized perspective view of yet another embodiment of the clip structure of the invention and having a general conformation similar to the clip structure shown in FIG. 6, the clip structure of FIG. 7 being formed of resilient strapping material.

FIG. 7 is essentially identical to the structure seen in FIG. 6 with the exception that the clip 100 is formed of two body elements 102 formed of resilient strap stock essentially identical to the material from which the clip 30 of FIGS. 1 and 2 is formed. In the structures of FIGS. 6 and 7, the ends of the respective body elements 82 and 102 can pivot relative to a supporting pan structure or can be fixed relative thereto. Similarly, the clip 80 of FIG. 6 and the clip 100 of FIG. 7 can be provided with structure which connects directly to structure such as the socket cup 90 but without pivoting of the respective body elements 82 and 102 relative to each other.

Figure 8:
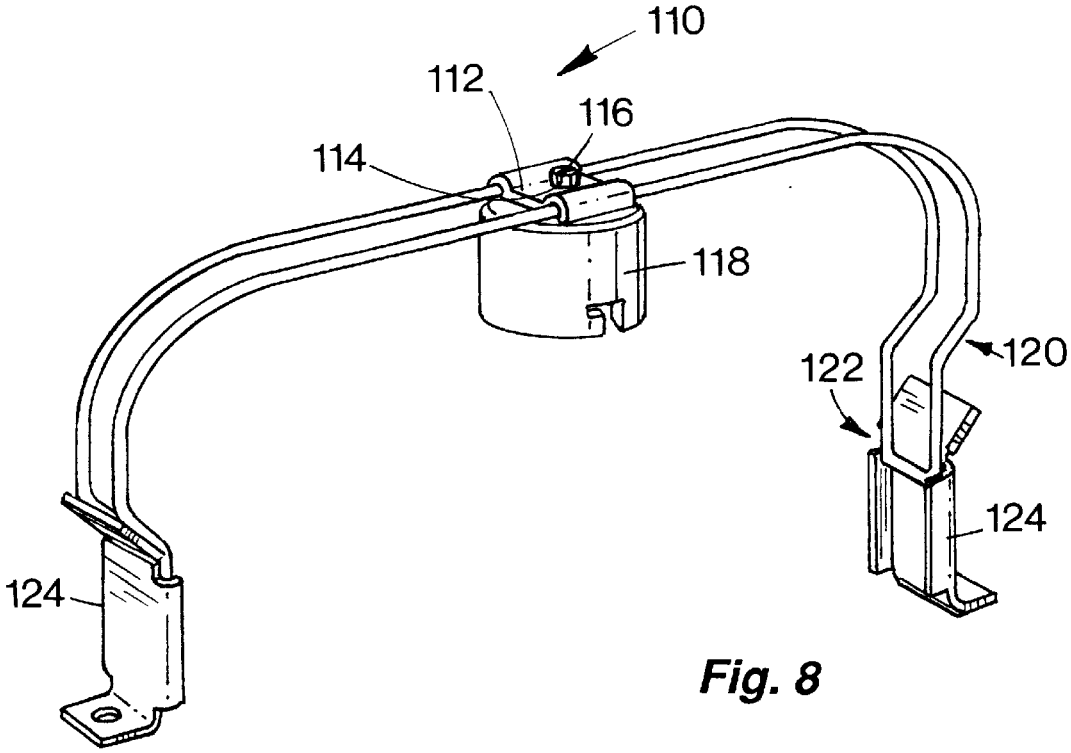
FIG. 8 is an idealized perspective view of a further embodiment of the invention wherein a mounting arrangement includes a clip structure formed of wire and having a central platform portion mountable to a socket cup or reflector of a lamp housing, ends of the clip snapping onto support structure mounted to a fixture pan.

Referring now to FIG. 8, a clip 10 which can be formed of either wire stock or spring strap stock is seen to be provided with a platform 112 disposed medially of the clip 110 and having an aperture 114 formed therein for receipt of a screw 116 which connects the clip 110 to a socket cup 118 or the like. As seen in FIG. 8, the clip 110 is formed of wire stock but could be readily formed of resilient strap stock in which case the platform 112 could be integral with the clip. In either situation, ends of the clip 110 can be formed with an inward reverse portion 120 which terminates in a downward yoke 122, the shape of the portion 120 and the yoke 122 fitting against and snapping into place on a channel bracket 124 connected to a supporting pan structure (not shown) at each end of the clip 110.

Figure 9:
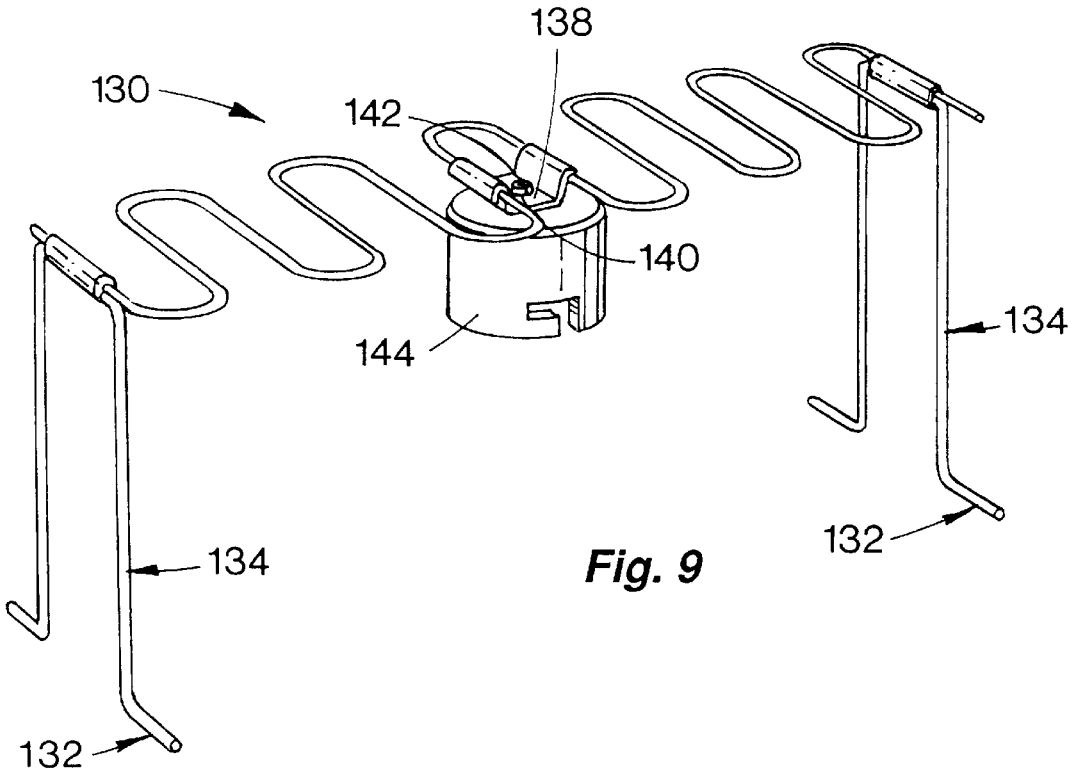
FIG. 9 is an idealized perspective view of a mounting arrangement having a clip structure formed of a sinusoidal wire element connected at each end to wire structure which is preferably integrally formed with a wire frame pan; and, FIG. 10 is an idealized perspective view illustrating a mounting arrangement having a clip formed of wire stock wherein a medial portion of the clip is attached to a socket cup or a reflector with ends of the clip being joined to a pan or similar support.

FIG. 9 illustrates in idealized form the mounting of a clip 130 to a wire frame pan 132 which is similar in structure to that wire frame pan described in U.S. Pat. No. 5,690,423, only portions of the pan 132 being seen and wherein those visible portions are shaped to form integral bight brackets 134 on opposite sides of a ceiling opening. The clip 130 is preferably formed of a relatively heavy gauge resilient wire formed into a sinusoidal configuration and being attached at each end to one each of the bight brackets 134. A mounting platform 138 attached to the clip 130 medially thereof and having an aperture 140 formed therein is thus connectable by means of a screw 142 to a socket cup 144 or directly to a reflector, trim or the like. The clip 130 could be formed of resilient strap stock material and connected to the brackets 134 at respective ends thereof. When formed of strap stock, the mounting platform 138 of FIG. 9 could be formed integrally with the clip structure which would thus result. The clip 130 is best configured with a slight upward bow or arch preformed into the clip 130.

Figure 10:
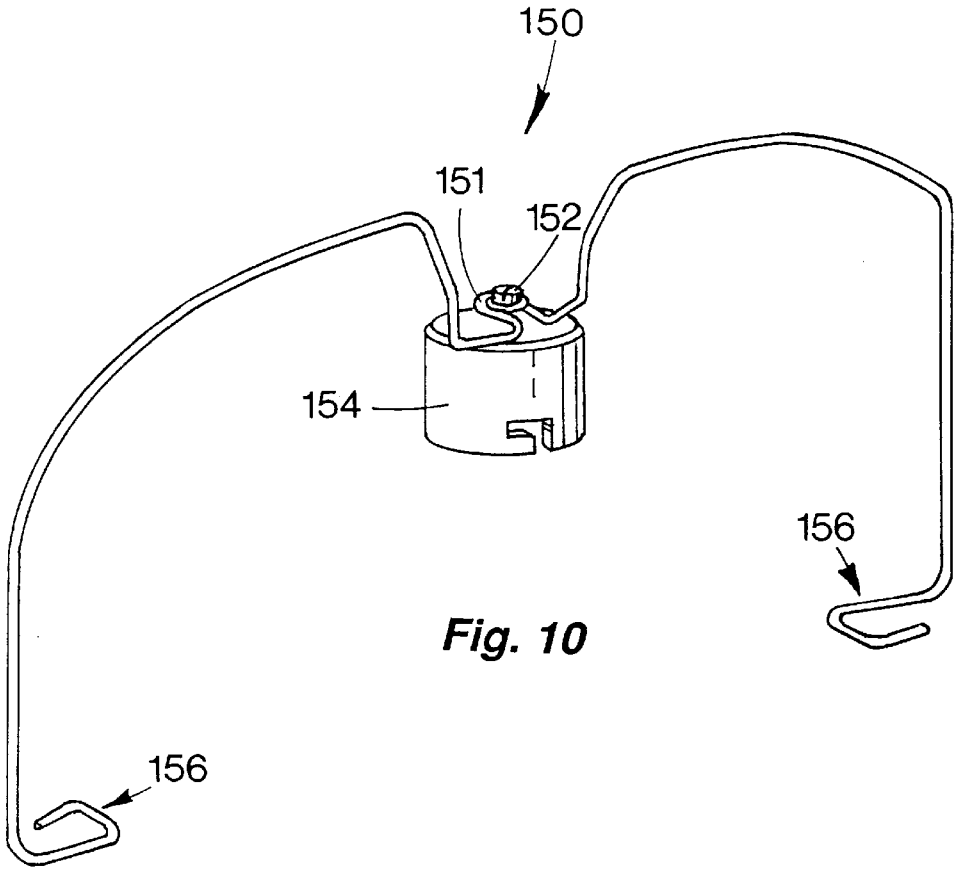

FIG. 10 is seen to illustrate a wire clip 150 having a central portion formed into a loop 151 capable of receiving a screw 152 for connection to a socket cup 154 or the like. Ends of the clip 150 would also be formed into loops along horizontal feet 156 at the respective ends of the clip 150 so that screws (not shown) could be employed to attach the clip 150 to a pan support structure (not shown). Portions of the clip 150 on either side of loop 151 are arcuately formed in order to facilitate exertion of an upward force on the socket cup 154 and thus on a trim or the like mounted thereto.

It can thus be seen that mounting arrangements according to the invention can take a variety of forms including the form of wire frame elements connecting to a pan including wire frame pans, such wire frame elements mounting resilient clips formed of wire stock or strap stock which exert continuous forces on a lamp housing, a lamp-mounting can having trim mounted therein or on trim per se, the salient feature of the invention being a mounting arrangement capable of exerting continuous and uninterrupted forces on structure of a fixture to cause a finishing flange to seat snugly against a ceiling opening so as to retain the finishing flange in a desired relation to the ceiling opening. Accordingly, while the invention has been explicitly described in relation to particular, embodiments of the invention, it is to be understood that the invention can be practiced other than as is explicitly shown without departing from the scope of the invention as to defined by the appended claims.

What is claimed is:

1. A mounting arrangement for a lighting fixture or the like having a support pan mounting a lamp housing connected to a finishing flange intended to be snugly engaged about an opening in a ceiling relative to which the fixture is mounted to direct light through the opening, comprising:

a single resilient clip connected to the lamp housing, the clip having ends of a width less than the width of a central body portion of the clip to define shoulders, the clip being connected to the lamp housing at a location near an upper portion of the housing, respective ends of the clip being disposed on opposite sides of the housing; and, support means mounted to the pan for engaging the ends of the clip to allow movement between the ends of the clip and said support means, shoulders of the clip preventing relative movement between the clip and the support means when the lamp housing is positioned relative to the opening in the ceiling, the single resilient clip being adequate to locate and retain the finishing flange in a desired position relative to the opening.

2. The mounting arrangement of claim 1 wherein the clip has a tab element joined to the free end of each of the ends thereof, the tab elements being angled relative to the ends of the clip.

3. The mounting arrangement of claim 1 wherein the clip is formed of a piece of spring steel stock having a thickness of approximately 0.020 inch.

4. The mounting arrangement of claim 1 and further comprising means carried by the support means for adjusting the height of locations of the support means engaging the ends of the clip above the support pan.

5. The mounting arrangement of claim 4 wherein the adjusting means comprise at least one scale indicating height above the support pan.

6. The mounting arrangement of claim 4 wherein the adjusting means comprises:

vertically oriented supports each having a guideway and respectively mounted to the pan oppositely across the lamp housing;

a yoke comprising the support means and having legs, each leg being received for sliding movement within the guideway of one of the supports; and, means carried by the yoke for fastening the yoke to the supports at a desired location of the legs of the yoke in the respective guideways of each of the supports.

7. The mounting arrangement of claim 6 wherein each of the yoke legs has a vertical slot formed therein and each of the supports have an aperture formed therein, which apertures respectively align with the respective slots on movement of the yoke legs within the respective guideways, the fastening means comprising a screw received through the slot and into the aperture adjacent thereto to hold the yoke and supports at a desired location relative to each other.

8. The mounting arrangement of claim 1 wherein the support means comprises a can within which the mounting arrangement is substantially disposed, the can having openings formed therein to receive respective ends of the clip and to allow movement of the ends of the clip relative to the can.

9. The mounting arrangement of claim 1 wherein the lamp housing comprises a reflector, the clip being connected to the reflector.

10. The mounting arrangement of claim 1 wherein the lamp housing comprises a reflector having a socket connected thereto, the clip being directly connected to the socket.

11. A resilient clip operable with a mounting arrangement of a lighting fixture having a support pan mounting a lamp housing connected to a finishing flange intended to be snuggly engaged about an opening in a ceiling relative to which the fixture is mounted to direct light through the opening, the mounting arrangement mounting to the pan, comprising:

a single resilient clip having a central body portion and ends of a width less than the width of the central body portion to define shoulders, the central body portion being connected to an upper portion of the lamp housing, the respective ends of the clip being disposed on opposite sides of the housing, the ends of the clip further being engaged for relative movement with the mounting arrangement, connection of the clip to the lamp housing and movement of the ends of the clip relative to the mounting arrangement to abut the shoulders of the clip against said mounting arrangement causing the finishing flange to be positioned snugly against the ceiling opening and causing a continuous force to be exerted on the lamp housing and thus on the finishing flange to retain said flange in position, the single clip being adequate to locate and to retain the finishing flange in said position.

12. The clip of claim 11 wherein the clip has a tab element joined to the free end of each of the ends thereof, the tab elements being angled relative to the ends of the clip.

13. The clip of claim 11 wherein the clip is formed of a piece of spring steel stock having a thickness of approximately 0.020 inch.

14. A mounting arrangement for a lighting fixture or the like having a support pan mounting a lamp housing connected to a finishing flange intended to be snugly engaged about an opening in a ceiling relative to which the fixture is mounted to direct light through the opening, comprising:

a resilient clip connected to the lamp housing, the clip having ends of a width less than the width of a central body portion of the clip to define shoulders;

support means surmounting the lamp housing and mounting to the pan for engaging the ends of the clip to allow movement between the ends of the clip and said support means, shoulders of the clip preventing relative movement between the clip and the support means when the lamp housing is positioned relative to the opening in the ceiling to locate the finishing flange in a desired position relative to the opening; and, means carried by the support means for adjusting the height of locations of the support means engaging the ends of the clip above the support pan, comprising vertically oriented supports each having a guideway and respectively mounted to the pan oppositely across the lamp housing, a yoke comprising the support means and having legs, each leg being received for sliding movement within the guideway of one of the supports, and, means carried by the yoke for fastening the yoke to the supports at a desired location of the legs of the yoke in the respective guideways of each of the supports.

15. The mounting arrangement of claim 14 wherein the clip has a tab element joined to the free end of each of the ends thereof, the tab elements being angled relative to the ends of the clip.

16. The mounting arrangement of claim 14 wherein the clip is formed of a piece of spring steel stock having a thickness of approximately 0.020 inch.

17. The mounting arrangement of claim 14 wherein the adjusting means comprise at least one scale indicating height above the support pan.

18. The mounting arrangement of claim 14 wherein each of the yoke legs has a vertical slot formed therein and each of the supports have an aperture formed therein, which apertures respectively align with the respective slots on movement of the yoke legs within the respective guideways, the fastening means comprising a screw received through the slot and into the aperture adjacent thereto to hold the yoke and supports at a desired location relative to each other.

19. The mounting arrangement of claim 14 wherein the support means comprises a can within which the mounting arrangement is substantially disposed, the can having openings formed therein to receive respective ends of the clip and to allow movement of the ends of the clip relative to the can.

20. The mounting arrangement of claim 14 wherein the lamp housing comprises a reflector, the clip being connected to the reflector.

21. The mounting arrangement of claim 14 wherein the lamp housing comprises a reflector having a socket connected thereto, the clip being directly connected to the socket.

22. A mounting arrangement for a lighting fixture or the like having a support pan mounting a lamp housing connected to a finishing flange intended to be snugly engaged about an opening in a ceiling relative to which the fixture is mounted to direct light through the opening, comprising:

a single resilient clip connected to the lamp housing at a location near an upper portion of the housing, respective ends of the clip being disposed on opposite sides of the housing;

support means mounted to the pan for engaging the ends of the clip to allow the clip to bias the lamp housing upwardly to engage the finishing flange about the opening in the ceiling to locate the finishing flange in a desired position relative to the opening the single clip being adequate to locate and to retain the finishing flange relative to the opening.

* * * * *